United States Patent [19]

Juricich et al.

[11] Patent Number: 4,630,292

[45] Date of Patent: Dec. 16, 1986

[54] FUEL TAX REBATE RECORDER

[76] Inventors: Ronald A. Juricich, 9220 Bayshore Dr., Silverdale, Wash. 98383; Ralph V. Sleeman, 17102 Meridian Ave. South, No. 70, Puyallup, Wash. 98373

[21] Appl. No.: 639,735

[22] Filed: Aug. 13, 1984

[51] Int. Cl.[4] ..... G07C 5/04

[52] U.S. Cl. ..... 377/20; 368/5; 368/6; 368/8; 340/52 D; 346/80; 377/15

[58] Field of Search ..... 346/33 D, 80; 377/19, 377/20, 15; 340/52 D, 52 F; 368/5, 6, 8

[56] References Cited

U.S. PATENT DOCUMENTS

| | | | |
|---|---|---|---|
| 14,381 | 10/1917 | Kjellgren | 377/20 |
| 1,195,280 | 8/1916 | Shipman | 386/8 |
| 1,414,910 | 5/1922 | Watson | 368/8 |
| 3,582,969 | 6/1971 | Kinney | 377/19 |
| 3,948,039 | 4/1976 | Leveraus | 368/6 |
| 4,338,512 | 7/1982 | Ludwig | 377/20 |
| 4,404,641 | 9/1983 | Bazarnik | 377/20 |
| 4,533,900 | 8/1985 | Muhlberger et al. | 340/52 D |

OTHER PUBLICATIONS

Society of Automotive Engineers, Oct. 1982, International Congress on Transportation Electronics Proceedings P-111, (pp. 137-145).

*Primary Examiner*—John S. Heyman
*Attorney, Agent, or Firm*—Seed and Berry

[57] ABSTRACT

A system for recording the total time that a motor vehicle is running, the time that the motor is running while the vehicle is stationary, and the time that the vehicle is running while the vehicle is moving. The system includes three electrically driven timers, one of which is connected in series with the oil pressure switch of the motor so that the timer is energized while the motor is running. The remaining two timers are alternately energized when the output of a speedometer generator is above or below a predetermined value. These timers are also connected in series with the oil pressure switch so that the timers may be not energized unless the engine is running. The record generated by the system can be used to obtain a rebate of road taxes for fuel used while the vehicle is stationary.

8 Claims, 3 Drawing Figures

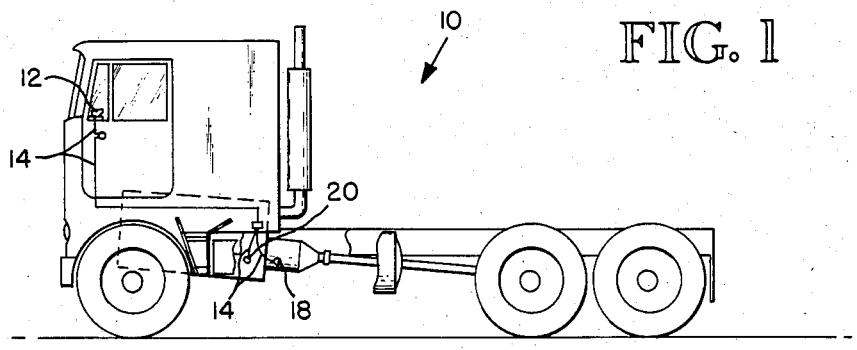
FIG. 1
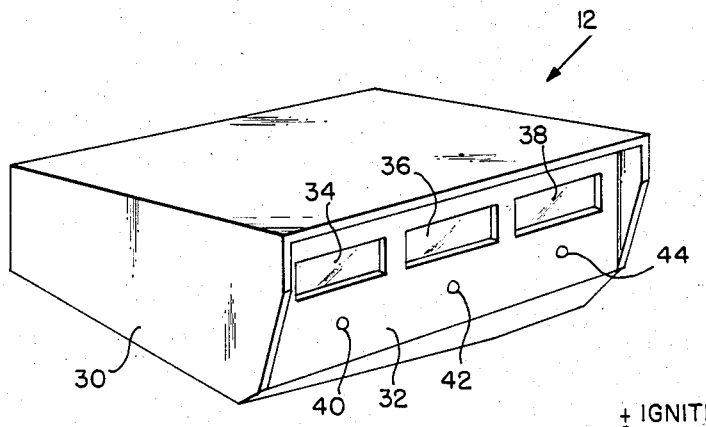
FIG. 2
FIG. 3
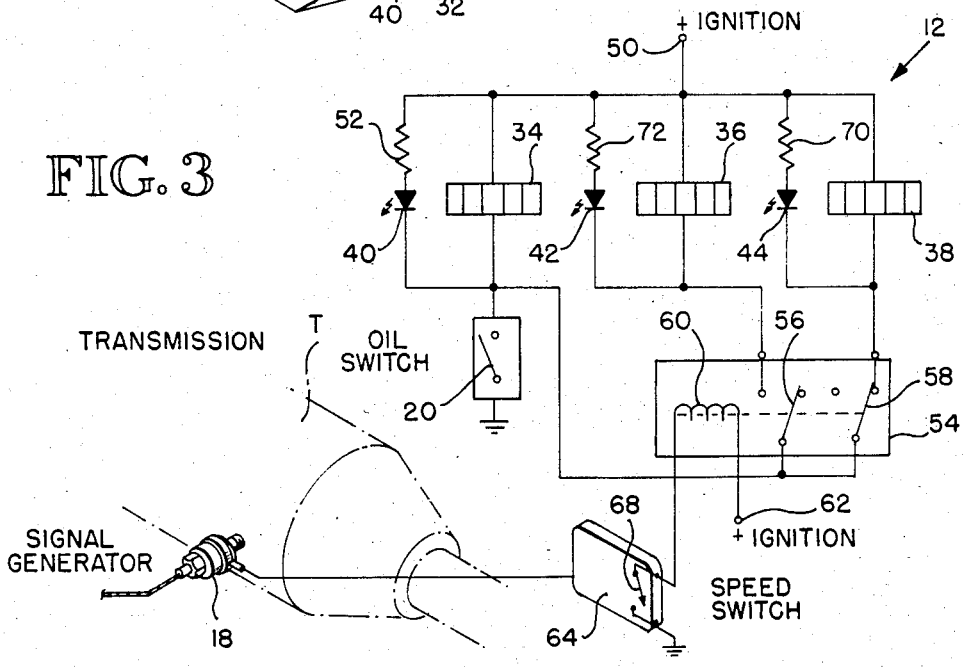

FUEL TAX REBATE RECORDER

TECHNICAL FIELD

This invention relates to hour meters for recording the running time of motor vehicles, and more particularly, to a system for allocating the running time of motor vehicles between statinary running time and in-motion running time in order to secure tax rebates for fuel burned during stationary running time.

BACKGROUND ART

The price of motor vehicle fuels generally includes a fairly substantial tax that is normally allocated to the construction and upkeep of public roadways. Purchasers of motor vehicle fuels thus normally pay a specific amount for each gallon of fuel purchased. Insofar as these taxes are allocated to public roadways, state taxing authorities will generally rebate the road tax portion of the fuel's purchase price if the purchaser can demonstrate that the fuel was not used in traveling along public roadways.

Although fuel tax rebates have been available for some time, such rebates have not generally been claimed, principally because of the difficult in maintaining adequate records to document the amount of such rebate. Obviously, the records must be inherently trustworthy and not susceptible to falsification. The burden of maintaining such records has, to date, outweighed the benefit of obtaining the rebate, heavy equipment, such as cranes, cement mixers, etc., that utilize a great deal of fuel while stationary at a fixed location.

Hour meters for recording the operating time of motor vehicles or certain components of motor vehicles are in common use. For example, gasoline and diesel engines are often serviced at specified time intervals, such as the oil in a gasoline engine being routinely changed every 100 hours of use. These conventional running time recorders measure only a single operating parameter and are thus incapable of allocating between various circumstances of running times, such as running time when the vehicle is in motion and running time when the vehicle is stationary. As a result, conventional running time recorders do not record the time that the motor of a motor vehicle is running while the vehicle is stationary, which would serve as a basis of obtaining a fuel tax rebate.

Although the fuel tax rebate is proportional to the amount of fuel used while the vehicle is stationary, the rebate is generally calculated on the basis of the time that the vehicle is stationary. State taxing authorities generally have tables listing the amount of fuel consumed for each hour of use while the vehicle is stationary. The amount of fuel used while the vehicle is stationary is then calculated on the basis of these tables from a record of the stationary running time of the vehicle.

DISCLOSURE OF INVENTION

It is an object of the invention to easily and inexpensively record the time that a motor vehicle is stationary while its motor is running.

It is another object of the invention to provide a system for automatically recording the running time of a motor vehicle and allocating between stationary and in-motion running times.

It is still another object of the invention to provide a stationary running time recorder that operates automatically without manual operation and is relatively tamper-proof, thus making records generated by the recorder inherently trustworthy.

It is a further object of the invention to provide a stationary running time recorder that generates redundant data to allow cross-verification of the data.

These and other objects of the invention are provided by a stationary running time recorder for motor vehicles in which a first signal generator produces an electrical signal when the motor of the vehicle is running. A second signal generator produces an indication when the vehicle is moving faster than a predetermined velocity. A timer connected to the first and second signal generators records at least two of three of the following time parameters: (1) the period of time that the first signal generator is providing an indication that the motor is running, (2) the period of time that the second signal generator is producing an indication that the vehicle is moving faster than a predetermined velocity, and (3) the period of time that the first signal generator is producing an indication that the motor is running but the vehicle is moving slower than the predetermined velocity. The first signal generator is preferably an oil pressure switch having an electrical contact that closes when the oil pressure reaches a normal operating level. The oil pressure switch is connected in series with an electrically driven timer and this series combination is connected in a DC power circuit so that the timer increments when the engine is running. The second signal generator is preferably a speedometer generator coupled to the drive train of the vehicle. The speedometer generator produces an electrical signal having a magnitude that is proportional to the speed of the vehicle. A voltage-sensing relay receives the output of the speedometer generator and closes a switch when the voltage reaches a level indicative of a speed above a predetermined value. The contact of the speed switch is preferably connected in series with the coil of a two-pole relay having one normally open contact and one normally closed contact. The contacts are connected in series with respective electronically driven timers and in series with the oil switch. Consequently, when the engine is running, one of the two timers is energized, depending upon whether the speed of the vehicle is above or below a predetermined value. The timers thus provide an indication of the total running time of the motor, the stationary running time of the vehicle, and the in-motion running time of the vehicle. Insofar as the in-motion and stationary running times can be determined from any two of the three timers, the system may utilize only two timers, or, in the alternative, three timers in order to provide redundancy and cross-verification of the timer indications.

BRIEF DESCRIPTION OF THE DRAWINGS

FIG. 1 is a side elevational view of a conventional truck having the inventive recording system installed therein.

FIG. 2 is an isometric view of the readout box that is normally mounted in the cab of a vehicle to provide an indication of the stationary and in-motion running times of the vehicle.

FIG. 3 is a schematic of the stationary running time recorder.

BEST MODE FOR CARRYING OUT THE INVENTION

The inventive fuel tax rebate recorder is shown installed on a conventional cab-over truck 10 in FIG. 1. The system includes a readout box 12 typically mounted on the dashboard of the vehicle. The readout box 12 is connected through a multi-conductor cable 14 to the ignition switch 16, which supplies the readout box 12 with DC power when the ignition switch 16 is on. The readout box 12 is also connected to a conventional speedometer generator 18 through cable 14. The speedometer generator 18 is coupled to the drive train of the vehicle 10, and it outputs a voltage having a magnitude that is proportional to the speed of the vehicle 10. Finally, the readout device 12 is connected to a conventional oil pressure switch 20 mounted on the motor of the vehicle 10. The oil pressure switch 20 has a normally open contact that closes when the oil pressure in the motor reaches operating pressure.

Although the fuel tax rebate recorder is shown installed on a cab-over truck 10, it will be understood that it may be installed on any motor vehicle. It is most advantageously installed on a motor vehicle that utilizes a relatively large amount of fuel while stationary.

The readout box 12, as best illustrated in FIG. 2, includes a generally box-like housing 30 having a front panel 32. The front panel includes three conventional electronically driven timers 34, 36, 38 typically known as "Hobbs" meters. The Hobbs meters are of the electro-mechanical type providing conventional well known number readout wheels sequentially rotated through a mechanical linking mechanism. Beneath each of the timer readouts 34–38 is a light-emitting diode 40, 42, 44, respectively providing a visual indication of operation. It will be understood that the shape of the housing 30, as well as the nature of the timer readouts 34–38, may be varied without departing from the scope of the invention. Similarly, as explained in greater detail below, the fuel tax rebate recorder may utilize only two of the three timers 34–38 and still provide complete information as to the stationary and in-motion running times of the vehicle 10.

A schematic of the readout device 12, along with the remainder of the fuel tax rebate recorder, is illustrated in FIG. 3. The readout box 12 is provided with DC power at point 50 from the ignition switch 16 (FIG. 1) of the vehicle 10. This DC power is applied to the series combination of the first timer 34 and the oil switch 20. The opposite end of the oil switch 20 is connected to chassis ground. When the motor of the vehicle 10 is running, the oil pressure is sufficiently high to close the switch 20, thereby completing a circuit through the timer 34. The timer 34 thus increments when the engine is running to record the running time of the motor.

The series combination of light-emitting diode 40 and the current-limiting resistor 52 are connected across the timer 34. When the oil switch 20 is open, the current path through the light-emitting diode 40 is also open. However, when the oil switch 20 closes, the cathode of light-emitting diode 40 is grounded, thereby allowing current to flow through the light-emitting diode 40 and provide a visual indication of the operating status of the readout device 12.

The second and third timers 36, 38, respectively, are also connected to the DC power provided by the ignition at node 50. The opposite terminals of the timers 36, 38 are connected to the terminals of a double-pole relay 54 having a normally open relay contact 56, a normally closed relay contact 58 and a relay coil 60 which, when energized, switches the contacts 56, 58. The opposite terminals of the contacts 56, 58 are connected to each other and to the oil pressure switch 20. Consequently, the lower terminals of the contacts 56, 58 are grounded when the oil pressure switch 20 is closed because the engine is running.

As mentioned above, the speed of the vehicle is measured by the speedometer generator 18. The speedometer generator may be a model MG0-1 MIN-GEN® signal generator sold by Synchro-Start Products, Inc. These signal generators connect to the speedometer cable fitting of the transmission, and they have an output fitting to which the speedometer cable can be connected. The speedometer cable is thus connected in series with the speedometer generator 18. The output of the speedometer generator 18 is a voltage having a magnitude that is proportional to the speed of the vehicle. It will be understood, however, that other devices may be used to provide an electrical indication that the vehicle is moving faster than a predetermined speed.

The output of the speedometer generator 18 is applied to a speed switch 64, which may be a conventional electronic speed switch, such as the model ESSC or model ESSB electronic speed switches sold by Synchro-Start Products, Inc. These switches contain an internal switch 68 and an internal adjustment that controls the voltage at and above which the switch 68 is closed. The speed at which the vehicle closes the switch 68 may thus be adjusted as desired. In any event, when the speed of the vehicle reaches and exceeds a predetermined value, switch 68 closes, thereby causing current to flow through the relay coil 60. Energization of the relay coil 60 causes the normally open contact 56 to close and the normally closed relay contact 58 to open.

When the vehicle is moving at a speed that is insufficient to close the contact 68 of the speed switch 64, the closed relay contact 58 completes a circuit from node 50 through timer 38 and the closed oil switch 20 (assuming the motor is running) to ground. The timer 38 thus increments to record the time that the vehicle is stationary while the motor of the vehicle 10 is running. When the contact 58 and oil switch 20 are closed, the cathode of diode 44 is at ground potential, thereby causing current to flow through current-limiting resistor 70 and the light-emitting diode 44. The light-emitting diode 44 thus provides a visual indication that timer 38 is energized. During the time that the vehicle is moving at a speed insufficient to close switch 68, relay contact 56 is open, thereby opening the circuit through timer 36.

When the speed of the vehicle 10 increases to a value sufficient to close switch 68, relay 60 is energized, thereby opening relay contact 58 and de-energizing timer 38 and light-emitting diode 44. At the same time, relay contact 56 closes, thereby completing a circuit through timer 36 and causing current to flow through current-limiting resistor 72 and light-emitting diode 42. Timer 36 then begins incrementing to record the time that the vehicle is running and in motion. Light-emitting diode 42 provides a visual indication of the operating status of timer 36.

It it thus seen that the inventive fuel tax rebate recorder automatically records the total running time of the motor, the stationary running time, and the in-motion running time. Furthermore, it does so in a manner that does not require any operatior intervention and which is relatively tamper-proof, thus making the recording inherently reliable. Although the tax rebate recorder may utilize only two of the three timers 34–38 to provide complete information as to the stationary and in-motion running time of the vehicle, the use of three timers 34–38 provides cross-verification of the recorded data and complete information without the need to perform calculations. Although one embodiment of the fuel tax rebate recorder has been illustrated in FIG. 3, it will be understood that the recorder can be implemeneted with other circuitry without departing from the scope of the invention.

We claim:

1. A fuel tax rebate recorder for motor vehicles, comprising:

a first signal generator producing a motor running indication when the motor of said vehicle is running;

a second signal generator producing a vehicle moving indication when said vehicle is moving faster than a predetermined velocity, said second signal generator including a speedometer generator coupled to the drive train of said vehicle, said speedometer generator producing an electrical signal having a characteristic that is proportional to the speed of said vehicle, said second signal generator further including a sensing device receiving the signal produced by said speedometer generator, said sensing device being triggered responsive to said speedometer generator indicating a speed exceeding a predetermined value, said sensing device producing said vehicle moving indication as said sensing device is triggered; and timer means for separately recording at least two out of three time parameters, said time parameters being the period of time that said first signal generator is producing said motor running indication, the period of time that said second signal generator is producing said vehicle moving indication above said predetermined velocity, and the period of time that said first signal generator is producing said motor running indication but said vehicle is moving below said predetermined velocity, said vehicle moving time indications above and below said predetermined velocity being incremented alternatively.

2. The fuel tax rebate recorder of claim 1 wherein said timer means records all three of said time parameters.

3. A fuel tax rebate recorder for motor vehicles, comprising:

an oil pressure switch having an electrical contact changing from one position to another as the oil pressure in said motor rises to and above normal operating pressure, said contact being connected in an electrical circuit providing a voltage across said contact to produce a motor running indication as said contact changes position;

a second signal generator producing a vehicle moving indication when said vehicle is moving faster than a predetermined velocity; and timer means for separately recording at least two out of three time parameters, said time parameters being the period of time that said first signal generator is producing said motor running indication, the period of time that said second signal generator is producing said vehicle moving indication above said predetermined velocity, and the period of time that said first signal generator is producing said motor running indication but said vehicle is moving below said predetermined velocity, said vehicle moving time indications above and below said predetermined velocity being incremented alternatively.

4. The fuel tax rebate recorder of claim 3 wherein said timer means include an electrically driven timer connected in series with said oil pressure switch, a source of DC power and ground so that a circuit through said timer is completed when the contact of said oil pressure switch closes.

5. The fuel tax rebate recorder of claim 1 wherein said sensing device is a voltage-sensing relay receiving the signal produced by said speedometer generator, said voltage-sensing relay being energized to move a relay contact from one position to another responsive to the signal produced by said speedometer generator indicating a speed exceeding a predetermined value, said relay contact being connected in an electrical circuit so that the voltage across said contact changes to produce said vehicle moving indication as said relay contact changes position.

6. The fuel tax rebate recorder of claim 5 wherein said timer means includes an electrically driven timer connected in series with said relay contact, a source of DC power in ground so that a circuit through said timer is completed when said relay contact closes.

7. The fuel tax rebate recorder of claim 6, further including an oil pressure having an electrical contact in series with said relay contact, said electrical contact changing from an open to a closed position as the oil pressure in said motor rises to and above normal operating pressure, whereby said electrically driven timer is precluded from incrementing unless said engine is running.

8. A fuel tax rebate recorder for motor vehicles, comprising:

first, second and third electrically driven timers, each providing a visual readout that increments when an electric current flows through said timer;

a double-pole relay having a normally open contact and a normally closed contact both of which are actuated by current flowing through a relay coil, said normally open contact being connected in series with said first timer and said normally closed contact being connected in series with said second timer;

a speedometer generator coupled to the drive train of said vehicle, said speedometer generator producing an electrical speed signal having a magnitude that is proportional to the speed of said vehicle;

an oil pressure switch having a contact that closes to connect a pair of terminals to each other when the oil pressure in the motor of said vehicle has a magnitude that is present during normal operating conditions, one terminal of said oil pressure switch being connected to said third timer and to the contacts of said relay;

a DC power source connected in series with said timers and said oil pressure switch; and a speed switch connected to said speedometer generator, said speed switch having a contact that closes when the magnitude of said speed signal is greater than a predetermined value, said contact being connected in series with a voltage source and the relay coil of said relay, whereby said third timer increments whenever said motor is running, said first timer increments whenever said motor is running and said vehicle is moving at a speed causing said speed signal to exceed said predetermined value, and said second timer increments whenever said motor is running and at a speed causing said speed signal to be less than said predetermined value.

* * * * *